US009325102B2

(12) United States Patent
Genta

(10) Patent No.: US 9,325,102 B2
(45) Date of Patent: Apr. 26, 2016

(54) SEALING ARRANGEMENT

(75) Inventor: Alessandro Genta, Alpignano Turin (IT)

(73) Assignee: Tyco Electronics AMP Italia S.R.L., Collegno, Turin (IT)

( * ) Notice: Subject to any disclaimer, the term of this patent is extended or adjusted under 35 U.S.C. 154(b) by 0 days.

(21) Appl. No.: 14/342,081

(22) PCT Filed: Aug. 17, 2012

(86) PCT No.: PCT/EP2012/066090
§ 371 (c)(1),
(2), (4) Date: Feb. 28, 2014

(87) PCT Pub. No.: WO2013/030014
PCT Pub. Date: Mar. 7, 2013

(65) Prior Publication Data

US 2014/0220803 A1 Aug. 7, 2014

(30) Foreign Application Priority Data

Sep. 2, 2011 (EP) ..... 11179913

(51) Int. Cl.
*H01R 13/52* (2006.01)

(52) U.S. Cl.
CPC ..... *H01R 13/521* (2013.01); *H01R 13/5216* (2013.01)

(58) Field of Classification Search
CPC ..... H01R 13/5221; H01R 13/5219; H01R 13/5202; H01R 13/521; H01R 13/5205; H01R 13/52; H01R 13/5216; H01R 43/005
USPC ..... 439/271, 274, 275, 587, 588
See application file for complete search history.

(56) References Cited

U.S. PATENT DOCUMENTS

| | | | | | |
|---|---|---|---|---|---|
| 4,425,017 | A | * | 1/1984 | Chan | 439/276 |
| 4,525,022 | A | * | 6/1985 | Murray | H01G 9/10 174/539 |
| 5,538,441 | A | * | 7/1996 | Paolucci | H01R 13/5208 439/587 |
| 5,934,922 | A | * | 8/1999 | Chiotis | 439/204 |
| 6,095,859 | A | | 8/2000 | Maeda | |
| RE37,340 | E | * | 8/2001 | King, Jr. | 174/87 |

(Continued)

FOREIGN PATENT DOCUMENTS

| | | | |
|---|---|---|---|
| DE | 19933829 | A1 | 2/2000 |
| GB | 2076843 | A | 12/1981 |
| WO | WO 2004/064202 | A1 | 7/2004 |

OTHER PUBLICATIONS

International Search Report and Written Opinion issued by the European Patent Office, dated Nov. 13, 2012, for related International Application No. PCT/EP2012/066090, 10 pages.

*Primary Examiner* — Neil Abrams
*Assistant Examiner* — Travis Chambers
(74) *Attorney, Agent, or Firm* — Faegre Baker Daniels LLP

(57) ABSTRACT

The present invention relates to a sealing assembly (100,200), which can be used for sealing an electric circuit of a connector (510). The sealing assembly includes a soft, elastic core (130), which is compact when deformed and which includes one or more inserting channels (132) for inserting contacts. The sealing assembly includes an outer inserting layer (110) and an outer exiting layer provided with protective elements (120) in correspondence with the inserting channels (132) and adapted to be positioned between the cutting edges of a contact and the sealing core (130) during insertion of the contact in the sealing assembly.

13 Claims, 5 Drawing Sheets

(56) References Cited

U.S. PATENT DOCUMENTS

| | | | | |
|---|---|---|---|---|
| 6,500,027 | B1 * | 12/2002 | Van Der Sanden et al. | 439/587 |
| 6,854,996 | B2 * | 2/2005 | Yaworski et al. | 439/276 |
| 7,201,596 | B1 * | 4/2007 | Bukovnik et al. | 439/276 |
| 2001/0023149 | A1 | 9/2001 | Murayama | |
| 2004/0121639 | A1 * | 6/2004 | Yaworski et al. | 439/276 |
| 2005/0159046 | A1 * | 7/2005 | Drescher | H01R 13/5205 439/587 |
| 2006/0189191 | A1 | 8/2006 | Drescher et al. | |

* cited by examiner

SEALING ARRANGEMENT

BACKGROUND OF THE DISCLOSURE

This invention relates to a sealing assembly for sealing a connector cavity and in particular for sealing an electric circuit of a connector. More precisely, the present invention relates to a sealing assembly including a sealing core having inserting holes and an outer inserting layer adapted to protect a lip profile of the inserting holes. Further, the present invention relates to a connector including the sealing assembly of the present invention.

Known prior art arrangements for sealing multiple contacts connectors consist of a substrate made of silicon material including several openings or insertion holes through which female or male contacts can be inserted so as to reach the corresponding mating contacts in the connector. The silicon material used for the sealing arrangement is elastic so that the insertion holes can be stretched upon insertion of the contact to allow the contact passing through the sealing arrangement. Once the contact is fully inserted in the connector, the insertion hole in the silicon sealing arrangement recovers its original shape and seals the cable contact so that no liquid or dirt penetrates the connector.

Such multiple seal arrangements are known in the art as "Grommet seals" and are preferred to single wire seals because their use simplifies the wiring process, since single wire seals do not have to be assembled directly on each wire. Moreover, using multiple seals allows reducing the dimensions of the connector, since the design does not require individual channels for housing each contact and the associated wire seal. However, the sealing performances of common Grommet seals are influenced by the design of the contact and the profile of the insertion hole of the seal. The profile of the insertion hole will be indicated in the following also as lip profile. Further, contact insertion and withdrawal from the cavity can cause damages to the profile of the insertion opening forming tears or cuts extending from the inserting hole into the sealing arrangement.

In the connector industry, contacts are classified in female and male contacts. Male contacts may be a tab (rectangular-shaped) or pin (square-shaped with surface equal or smaller than 1 $mm^2$). Female contacts used for automotive applications may have a rectangular shape or a square shape and in some cases a round shape. Therefore, during contact insertion into the inserting hole, which is typically circular and has a smaller section than the contact and the cable to be sealed, the insertion force of the contact is concentrated on the portions of the lip profile contacting the vertices of the contact housing. Consequently, these portions of the lip profile are exposed to high elongation and stresses, which cause tears or cuts. In addition, if the contact is stamped, the edges of the contact may have burrs which can damage portions of the grommet seal that comes into contact with the contact pin. Cuts in the profile of the insertion opening prejudice the sealing performance of the multiple seal.

A connector cavity 600 including a Grommet seal 610 according to the prior art is shown in FIG. 6. In this figure, the contacts 300 are in their final position and are sealed by the Grommet seal 610.

FIG. 7 shows a circular insertion hole 720 of a Grommet seal 610 according to the prior art. In particular, the Grommet seal 610 includes an entry region 710 made of a tin elastic layer of silicon or rubber. The insertion hole 720 is located at the center of the entry region 710.

FIG. 8 shows an insertion process of a female contact 300 into the Grommet seal 610. In particular, the elastic layer of rubber of silicon of the entry region 710 is stretched during insertion of the female contact 300. Once the contact 300 has been completely passed through the insertion hole, the entry region 710 will recover its original shape so as to be tight around the contact cable.

FIG. 9 shows a top view of a Grommet seal 610 according to the prior art. The tears or cuts 650 that extend from the border of the insertion holes 720 along the surface of the Grommet seal 620 are ruptures of the seal due to the high stresses caused by reiterated insertions and withdrawals of contacts into the connector cavity.

In order to increase the lifetime of a Grommet seal and its sealing properties, several solutions are known in the art. As an example, Grommet seals, such as those described with reference to FIGS. 7 to 9 may be lubricated so as to facilitate a smooth insertion of the contacts. However, this solution can not avoid concentrating high stresses on specific portions of the lip profile during insertion of a contact. Therefore, while using lubricated materials might help protect the entry region of a Grommet seal 600 from cuts caused by the rough surface of a contact, this solution cannot avoid structural damages caused by overstretching the Grommet seal around the entry region during insertion of a contact.

Alternatively, other solutions known in the art for sealing connector cavities involve the use of greases or gel materials. These materials are capable of withstanding high stresses, since they lack a structural network. However, despite the fact that the sealing performances of gel sealants were found to be very good, this solution has several shortcomings. More precisely, due to the lack structural network, the sealant results to be generally viscous and changes its structure when subjected to temperature changes, thereby providing an unstable means for protecting the contacts or wires. Further, when a contact is passed through the gel, portions of the gel sealant contacting the edges of the contact are exposed to a high pressure and the contact takes away some particles of the gel. This makes the wiring surface of the contact dirty after few insertions and withdrawals during the testing process of the connector. Moreover, the presence of non-conductive particles on the contacts causes a deterioration of the conduction properties of the contacts, thereby compromising the correct functioning of the connector.

SUMMARY OF THE DISCLOSURE

Therefore, it is an object of the present invention to provide a sealing assembly that is not affected from lip profile damages during contact insertion or withdrawal through the sealing arrangement and which has an improved sealing performance. Further, it is an object of the present invention to provide a sealing assembly that can be easily deformed during insertion or withdrawal of the contacts. Finally, it is a further object of the present invention to provide a sealing assembly that can assure a good sealing performance in a wide range of applications and in particular in connectors exposed to large temperature changes.

This object is solved by the subject matter of the independent claims. Advantageous embodiments of the present invention are the subject matter of the dependent claims.

The present invention is based on the observation that tears or cuts in the lip profiles of Grommet seals are mainly caused by the contact of the rough surface of the contacts with the sealing assembly and by the stresses due to overstretching the entry region of the sealing assembly during insertion or withdrawal of contacts. More precisely, ruptures of the lip profiles mainly occur because the stresses are concentrated in a very narrow portion of the lip profile coinciding with the points of contact between the lip profile and the contact.

In order to overcome the above-mentioned drawbacks, the present invention provides a seal assembly including an external Grommet surface for directly contacting the contact and an internal soft and elastic core, which is capable to recover its original structure after deformation so as to be tight around the contact cable once the contact is completely inserted into the sealing assembly. The external Grommet surface is an outer layer having a protecting member on which the surface of a contact abuts during the insertion process. The protecting member is made of a material, which is resistant to scratches and which is smooth at least on the side contacting the internal core. The protecting member will be positioned between the internal core and the contact during the insertion of the contact into the sealing assembly. Since the protecting element is smooth on the side contacting the internal core, cuts or tears in the internal core produced by contacting the rough surface of the contact can be avoided. Moreover, the protecting member redistributes the pressure over a larger area of the lip portion, thereby reducing the mechanical stresses exerted by the edges of a contact onto narrow portions of the lip profile.

A sealing assembly according to an embodiment of the present invention may comprise a sealing core having an inserting face provided with an inserting channel adapted to receive a contact pin. The sealing assembly may further include a first outer layer arranged on the inserting face of the sealing core and including at least one protecting element arranged so as to correspond to the inserting channel. An inner face of the protecting element is adapted to contact a lip profile of the inserting channel, and the protecting element is adapted to be positioned between the lip profile and an edge of the contact upon insertion of the contact into the sealing assembly. According to this realization, the protecting element is disposed, during insertion of a contact into the sealing core, between the edge of the contact and the lip profile. In this manner, a contact between the cutting edge of the contact and the lip profile can be prevented, thereby preventing the formation of cuts in the lip profile.

According to an advantageous development of the present invention the protecting element may be provided with a free end, which extends over the lip profile of the inserting channel. As an example, the free end may be a hole in the centre of the protecting element substantially aligned with the inserting hole.

According to a further advantageous development, the protecting element may include a plurality of protecting fins which surround, at least partially, the inserting channel. Upon insertion of a contact into the sealing assembly, the pressure is concentrated along the edges of the contact and in particular at the vertices of the contact pin. Since the protecting element surrounds a large portion of the lip profile, the pressure exerted from the contact is homogeneously redistributed over a large portion of the lip profile. This prevents applying high stresses to the structure of the sealing core, thereby improving the sealing performance of the sealing assembly.

The protecting element may also be a protective film integrally covering the inserting channel. In an advantageous embodiment of the present invention, the protecting film may be crossed by at least one groove adapted to brake so as to form protecting fins. In this manner the inserting channel is hermetically sealed below the outer layer until the contact is inserted into the sealing assembly. This prevents depositing within the inserting channel dust or any other substance that may deteriorate the sealing performance of the sealing assembly. The grooves are blind cuts in the protecting film which can be easily broken by applying the pressure necessary for inserting a contact into the sealing assembly.

The sealing core may preferably be made of an elastic deformable material, while the outer inserting layer may be made of a hard material. In order to prevent damaging the lip profile of the inserting channel, the first outer layer may be smooth, at least on the side facing the inserting face of the sealing core. Alternatively, only the protecting element may have smooth surface. This is enough to prevent damaging the lip profile since the protecting element is the only portion of the first outer layer that can contact the lip profile.

The sealing assembly may further include a second outer layer arranged on an exiting face of the sealing core opposing the inserting face. The second outer layer has at least one protecting element arranged so as to correspond to the inserting channel. The protecting element may be adapted to contact with an inner face thereof a lip profile of the inserting channel, and may be further adapted to be positioned between the lip profile and an edge of the contact upon withdrawal of the contact from the sealing assembly. The second outer layer protects the sealing core upon withdrawal of the contact from the sealing assembly. Accordingly, it is possible to prevent formation of cuts or tears on the lip profile of the inserting channel on the exiting face of the sealing core. This further improves the sealing performances and the lifetime of the sealing assembly.

The sealing assembly may further include an outer body enclosing the sealing core. The outer body includes a side face. The first and second outer layers are opposing faces of the outer body and are joined through the side face.

In an advantageous development of the present invention the sealing core may be a gel and the outer inserting layer may be made of a silicon material. Gel materials do not have a defined structural network and can, therefore, be stretched and deformed without losing sealing performance. Sealing assemblies including a gel sealing core may be therefore used for sealing large sized contacts, such as 1.5 mm and 2.8 mm contacts, as well as small sized contacts, such as 0.6 mm or even less. Good sealing performances can also be obtained in sealing small diameter cables connected to large sized contacts.

In a further development of the present invention the side faces of the outer body have one or more grooves.

A further advantageous embodiment of the present invention relates to a connector enclosure for an electric circuit. The connector enclosure has side faces and at least one open face and includes a sealing assembly as described above.

In an advantageous development of the present invention the sealing assembly includes a side face having at least one groove. The side faces of the connector enclosure may include at least a securing lip adapted to engage with the at least one groove so as to secure the seal arrangement in a predetermined position.

The accompanying drawings are incorporated into and form part of the specification for the purpose of explaining the principles of the invention. The drawings are not to be construed as delimiting the invention to only the illustrated and described examples of how the invention can be made and used. Further features and advantages will be apparent from the following and particular description of the invention as illustrated in the accompanying drawings, wherein like reference numbers refer to like elements and wherein:

DETAILED DESCRIPTION

Figure 1:
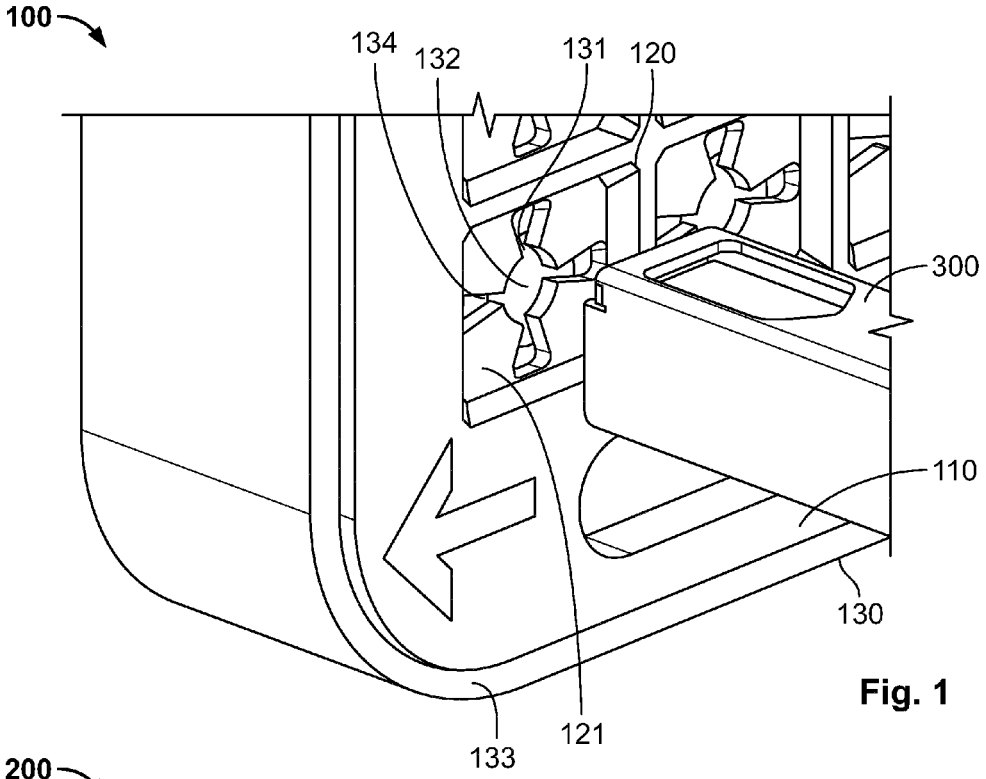
FIG. 1 is a perspective view of a portion of a sealing assembly according to an embodiment of the present invention.

In the following description, for explanatory purposes, specific details are set forth in order to provide a thorough understanding of the present invention. However, it may be evident that the present invention can be practiced without these specific details. Furthermore, well-known structures of the devices are only described in a more general form in order to facilitate the description.

In the following description, the expression "lip profile" is used to indicate the border of an inserting hole of the sealing assembly. Further, it has to be understood that the inserting hole is a through hole crossing the sealing core. Finally, the term connector is used in the following to indicate any of male or female connectors used in automotive applications.

The problem underlying the present invention is based on the observation that during insertion of the contact into a seal Grommet, a high pressure is concentrated at the points of the lip profile contacted by the vertices of the contact. Further, the edges of the contact might be rough or may have cutting edges caused by the stamping and manufacturing process of the contact. This can produce cuts or tears in the sealant. More precisely, if the impacting surface of the contact is large compared with the area of the insertion hole in the sealant, the pressure exerted by the contact vertices onto the contacting area of the lip profile may cause structural stresses that cause ruptures along the lip profile or may damage the structural network of the seal, thereby reducing the sealing performance of the Grommet seal.

According to the present invention, the sealing assembly includes a sealing core made of a soft, elastic material, which is compact when deformed. The sealing core includes one or more insertion channels for inserting a contact. A protecting outer layer is arranged at least on top of the inserting face of the sealing core and includes an entry region functioning as protecting element arranged so as to correspond to the inserting channel of the sealing core. The outer layer is made of a hard material, which is resistant to scratches and is insensitive to the cutting edges of a contact. The protecting element is positioned so as to at least partially surround the inserting hole and can move inwardly towards the sealing core. An abutting surface of the protecting element facing outwardly from the sealing assembly is adapted to abut the contact. The protecting element is arranged so as to be positioned between the edges of a contact and the sealing core during insertion of the contact into the sealing assembly. The outer layer is designed to cover the entire inserting face of the sealing core.

Since the outer surface is hard, damages caused by the cutting edges of a contact are prevented. At the same time, the inserting surface of the sealing core and in particular the lip profile of the insertion channel is never in direct contact with the metallic surface of the contact, but only with a back face of the protecting element. The back face of the protecting element is the face opposing the abutting surface and is smooth so that cuts or tears in the sealing core can be prevented. Finally, the protecting element further distributes the pressure exerted by the vertices of the contact over a portion of the lip profile larger than the abutting region of the contact, thereby preventing concentrating tensional stresses on the portion of the lip profile contacting the edges.

FIG. 1 is a perspective view of a particular of a sealing assembly 100 according to an embodiment of the present invention. The sealing assembly 100 includes a sealing core 130. An inserting channel 131 is provided through the sealing core 130. The inserting channel 131 ends on an inserting face 133 and on an exiting face (not shown) of the sealing core 130 with an inserting hole 132. The inserting hole 132 defines a circular lip profile 134 on the inserting surface 133 of the sealing core 130. The sealing core 130 is made of a soft and elastic material, which is compact when deformed.

During insertion of a contact 300 into the sealing core 130, the inserting channel 131 as well as the inserting hole 132 and the lip profile 134 can be stretched over their dimensions at rest so as to allow the contact 300 to pass through the sealing core 130.

Once the contact 300 has completely passed through the sealing core 130, the inserting channel 131, the inserting hole 132 and the lip profile 134 will recover their original shape and section. Consequently, the inserting channel 131 will be tight around the contact cable along the entire surface of the contact cable (not shown) so that the contact and any electrical circuit that may be in the connector are watertight and dust-tight. The sealing assembly further includes a first outer layer 110 arranged on the inserting face 133 of the sealing core 130. The first outer layer may also be indicated as outer inserting layer. The outer inserting layer 110 is positioned so as to contact the inserting face 133 and is fixed to the inserting face 133, for example by means of an adhesive layer. The adhesive layer may be a film of any glue suitable for this purpose.

The outer inserting layer 110 is made of a hard material that is resistant to scratches, but is flexible so as to be bended without causing structural damages in its internal structure. The outer inserting layer 110 is provided with one or more entry regions 120 arranged in the outer layer 110 so as to correspond to the inserting channels 131. As an example, the outer inserting layer 110 may be designed so that the center of each inserting channel 131 is aligned with the center of a corresponding entry region 120. The entry region 120 is a portion formed in the inserting layer 110 and having a shape and a surface that substantially corresponds to the contacting surface of a connector 300. The entry region 120 has a rectangular shape and is designed to correspond to the contacting surface of a female 300. However, this design is not limiting and the entry region 120 may have any shape and may be formed so as to substantially correspond to contacts with different dimensions and shape according to the particular application in which the sealing assembly is used. The entry regions 120 have the function of a protecting element for protecting the lip profile 134 form the rough edges of the contact 300 and may be further used as guidance for correctly positioning the contacts 300 above the inserting channels 131 before insertion.

The entry region 120 further includes protecting fins 121. In particular, in the embodiment of FIG. 1, the entry region 120 includes four protecting fins 121, each extending from a corner of the entry region 120 towards the inserting hole 132 in a direction parallel to the plane of the inserting face 133. The protecting fins 121 become narrower towards the center of the entry region 120 so that free ends thereof substantially cover the lip profile 134. Since the outer layer 110 is flexible enough to be bended, a pressure exerted from the contact 300 on the protecting fins 121 will cause the protecting fins 121 to be bent inwardly towards the sealing core 130.

During insertion of the contact 300 into the sealing arrangement 100, the protecting fins 121 will be pressed against the lip profile 134 of the inserting hole 132, thereby stretching the lip profile 134 so as to allow the contact 300 to pass through the sealing assembly 100. Upon stretching the inserting hole 132, the inserting channel 131 is also stretched with respect to its original dimensions. Therefore, the contact 300 can be easily passed through the channel 131 without exerting a high pressure in the walls of the channel and thus without damaging the structure of the sealing core 130.

The sealing assembly 100 further includes an second outer layer (not shown), having the same structure of the outer inserting layer 110 and being arranged on an exiting face of the sealing core opposing the inserting face. The second outer layers may be also indicated as outer exiting layer. The inserting and exiting layer are identical and are merely defined by the orientation of the sealing arrangement 100 with respect to the contact 300 to be inserted. More precisely, the exiting layer may be used as well as an inserting layer and vice-versa. The outer exiting layer has one or more protecting elements arranged so as to be substantially aligned to the protecting elements 120 of the outer inserting layer 110. The protecting elements (not shown) have the same shape and structure of the protecting elements 120 and may include a plurality of protecting fins 121 adapted to be moved inwardly towards an exiting face (not shown) of the sealing core 130. Upon withdrawal of a contact 300 from the sealing assembly 100, the protecting fins 121 are pressed against the lip profile 134 of the inserting hole on the exiting face of the sealing core 130, thereby protecting the sealing core 130 and in particular the lip profile on the exiting face from being directly contacted by the contact 300. Further, the protecting fins 121 distribute the pressure exerted from the corners of the contact 300 over the entire lip profile of the exiting hole so as to homogeneously stretch the inserting hole and the inserting channel 131 and allow withdrawal of the contact without overstressing the lip profile 134.

The protecting fins 121 on the outer inserting layer 110 and on the outer exiting layer are arranged so as to contact with a bottom face the sealing core 130 and with an upper face the contacting area of the contact 300. During insertion or withdrawal of the contact 300 into the sealing assembly, the protecting fins 121 will be placed between the edges of the contact surface or of a back face of the contact 300 and the lip profile 134 of the inserting hole 132, thereby preventing direct contact between the surface of the contact 300 and the sealing core 130. The back face of the contact is the face connected to a cable.

The inserting channel 131 as well as the inserting hole 132 in the sealing assembly 100 has a circular section. However, this shape does not have to be considered limiting in any way and the inserting channel 131 and the inserting hole 132 may be designed so as to have any section.

The sealing core 130 may be a gel, which is compact when deformed, but has very good elastic properties and can be stretched so as to allow insertion of the contact 300. The outer inserting layer 110 as well as the outer exiting layer may be made of a hard silicon material, which is insensitive to the cutting edges of the contact 300. The outer inserting layer 110 and the outer exiting layer may also be a film of hard plastic material applied on the inserting face 133 and the exiting face of the sealing core 130 as explained above.

Although gel materials tend to leave residues, such as gel particles, on the surface and within the housing of a contact, the protecting fins 121 prevent the edges of the contact directly contacting the lip profile 134 of the gel core during the first phase of the insertion of the contact into the seal assembly. In this phase the contact is pushed against the inserting face of the sealing assembly with a force suitable for stretching the channel 131 to a dimension that allows inserting the contact. Consequently, if the contact were directly pressed against the gel core 130, the latter would leave residues on the contact. Since, however, the protecting fins 121 are positioned between the edges of the contact 300 and the lip profile 134, the latter is not scratched by the contact edges and thus the contact does not collect gel residues.

Alternatively, the sealing core may be made of silicon or rubber material with a high degree of elasticity and which can be stretched over its original dimensions without loosing the capability of recovering its original shape once the contact has been passed through.

Figure 2:
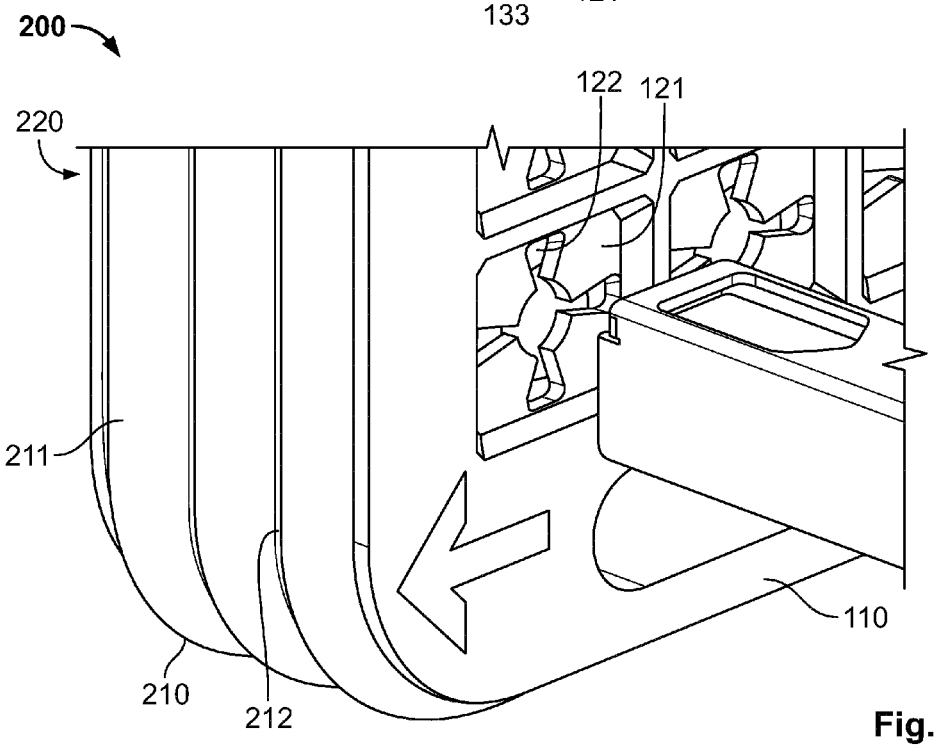
FIG. 2 is a perspective view illustrating a portion of sealing assembly in accordance with a further embodiment of the present invention.

FIG. 2 is a perspective view of a particular of a sealing assembly 200 according to a further embodiment of the present invention. The sealing assembly 200 includes a sealing core 130, an outer inserting layer 110 and an outer exiting layer (not shown). These elements have the same design as the corresponding elements of the sealing assembly 100 and will be indicated with the same reference sings. The elements already described with reference to the embodiment of FIG. 1 will not be described.

The sealing assembly 200 further includes a side face 210 enclosing a side face of the sealing core 130 and extending from the outer inserting layer 110 to the outer exiting layer. The outer inserting layer 110 and the outer exiting layer are joined on each side through the side face 210 so as to form an outer body 220 completely enclosing the sealing core 130. The side face 210 of the sealing assembly 200 may also include a plurality of grooves 212 and protrusions 211 that extend along the entire surface of the side face 210 in a direction parallel to the plane of the other inserting layer 110.

The outer body 220 may be molded in two steps by firstly forming a silicon cavity including a first outer layer, such as the outer inserting layer 110, and the side face 210, and subsequently a second outer layer, such as the outer exiting layer. The sealing core 130 may be inserted in the silicon cavity by injecting the gel or a silicon paste. The sealing assembly 200 may then be cured so as to harden the injected sealing core 130. Alternatively, the sealing core 130 may be formed and hardened in a separate manufacturing step and subsequently positioned into the silicon cavity. The sealing assembly 200 is obtained by mounting the second outer layer on the silicon cavity.

Alternatively, the sealing core 130, the side face and the outer layers of the outer body may be produced independently and the sealing core 130 may be subsequently inserted into the side face 210. The sealing assembly 200 may then be further completed by mounting the outer inserting layer 110 and the outer exiting layer so as to cover the inserting face 133 and the exiting face of the sealing core 130.

In a further alternative manufacturing process the sealing assembly 100 according to the embodiment of FIG. 1 may be obtained by molding and curing the sealing core 130, and the outer layers and subsequently fixing the outer layers on the inserting and exiting faces of the sealing core 130.

Figure 3:
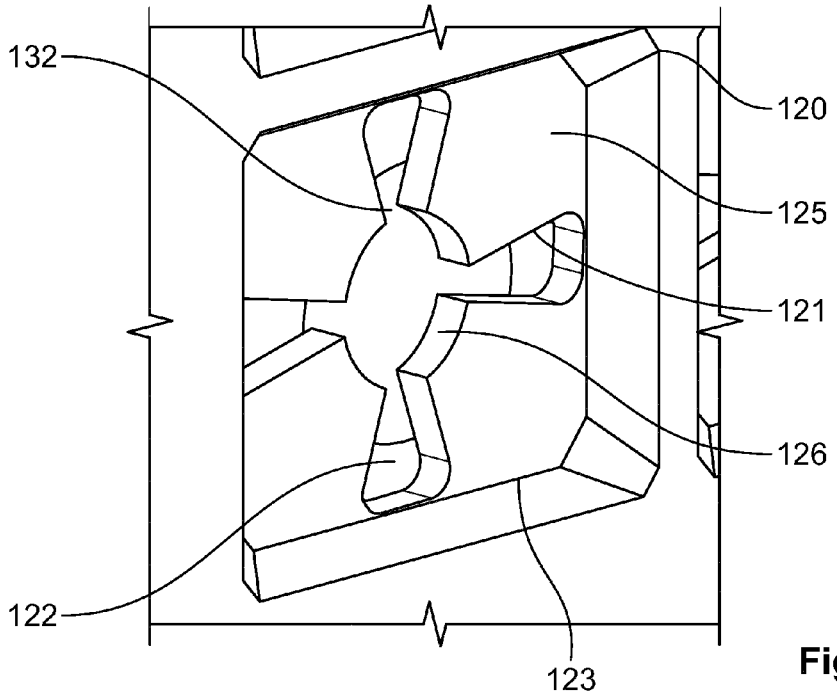
FIG. 3 is a top view of a detail of an entry region according to an embodiment of the present invention.

FIG. 3 is a particular of the protecting element 120 according to an embodiment of the present invention. The protecting element 120 has a rectangular shape, whose area substantially corresponds to the surface of the contacting face of a contact (not shown), and includes four protecting fins 121 extending from each vertex of the protecting element 120 towards the inserting hole 132 of the sealing core 130. A base 123 of the protecting fin 121 extends from a vertex of the protecting element 120 along adjacent sides thereof. Each protecting fin 121 is separated from neighboring protecting fins 121 by a drop shaped slit 122.

The protecting fins 121 extend towards the center of the protecting element 120 so that a free end 126 of the protecting fins 121 is beyond the lip profile 134 of the inserting hole 132 and the lip profile 134 is at least partially surrounded by the protecting fins 121. In this manner, when the protecting fins 121 are pushed inwardly towards the sealing core by the contact 300, an inner face of the protecting fins 121 contacts the lip profile 134 and protects same from contacting the cutting edges of the contact 300.

Although in the embodiment of FIG. 3, the protecting element 120 has a rectangular shape and includes four protecting fins 121, the protecting element 120 may have any other section, such a circular or the like. Further, the protecting element 120 may include more than four protecting fins 121.

In a further advantageous embodiment, the protecting element 120 may have a circular section and may include a plurality of plastic or silicon bands arranged along its the perimeter and extending towards the inserting hole 132 in a plane parallel to the inserting face 130.

Alternatively, the protective element 120 may be one single protecting film made of an elastic material, such as silicon, adapted to be resiliently bent inwardly towards the inserting channel 131 upon insertion of a contact 300. The protecting film may be provided with an aperture positioned so as to be substantially aligned to the inserting hole 132 in a way that the edge of the aperture extends over the lip profile 134. The aperture may have any shape and generally is chosen to have the same shape of the inserting hole 132. The aperture corresponding to the inserting hole 132, provided in the protecting film allows to more easily stretching the protecting film so as to facilitate the insertion of the contact 300.

Alternatively, the protecting element 120 may be a film that entirely covers the inserting hole 132. According to this embodiment, the protecting film may be provided with grooves adapted to brake upon applying a predefined pressure to the protecting film. If the protecting film has a rectangular shape two grooves connecting opposing vertices may extend along the diagonal of the protecting film. The grooves may be obtained by making blind cuts along the surface of the protecting film. The predefined pressure needed to break the protecting film may be equal or smaller that the pressure required for inserting the contact 300 into the inserting channel 131. The predefined pressure may also be larger that the pressure required for inserting the contact 300. In this case an accidental rupture of the blind cuts prior to insertion of the contact 300 can be prevented. Upon breaking the blind cuts, the protecting film will brake into a plurality of protecting lips or fins that will be positioned between the edges of the contact 300 and the lip profile 134 of the inserting hole 132 during insertion of the contact, as already explained with reference to FIGS. 1 to 3.

The protecting film may be a portion of the outer layer, which is thin compared with the thickness of the outer layer.

The sealing function of the sealing assembly is performed by the sealing core 130 positioned between the outer inserting face 110 and the outer exiting face. Therefore, although the protective element is not made of a hard silicone material and might be damaged by the rough surface of a housing of the contact 300, a good sealing performance will be ensured by the sealing core 130.

Figure 4:
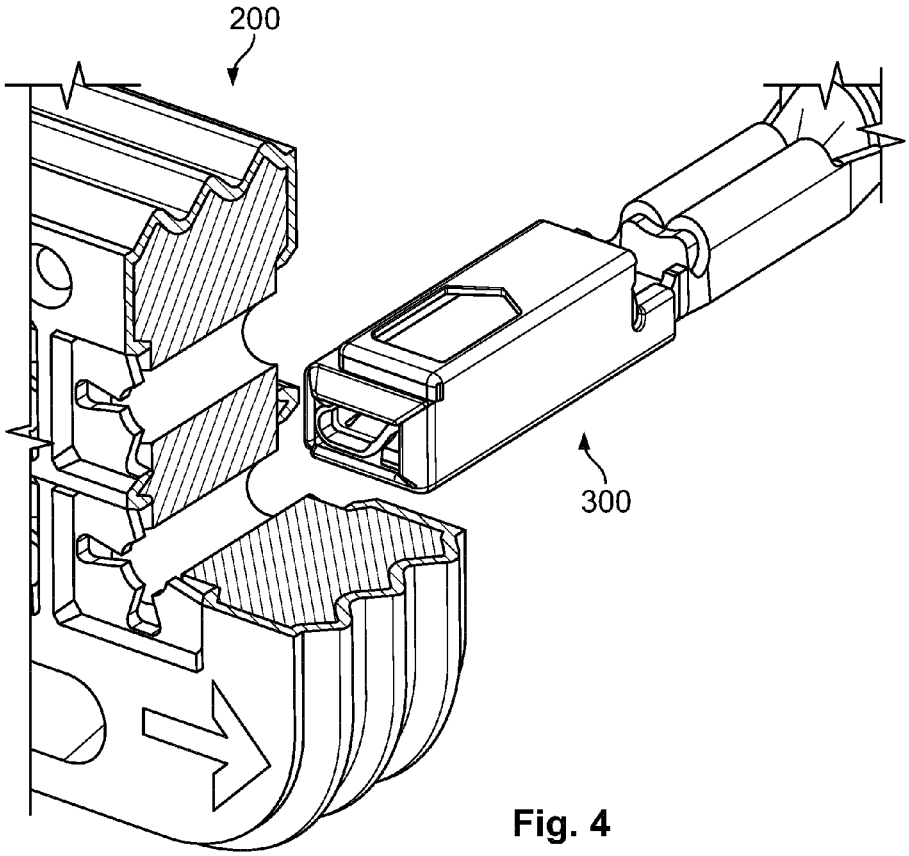
FIG. 4 is a perspective view of a sealing assembly according to an embodiment of the present invention and a contact.

FIG. 4 is a perspective view of a portion of a sealing arrangement 200 and a connector 300 according to an embodiment of the present invention. Although FIG. 4 illustrates the sealing arrangement 200, the same concept can also be applied to the sealing arrangement 100 illustrated in FIG. 1.

Upon inserting a contact 300 into the sealing assembly 200, the cutting edges of a contacting face of the contact 300 abut on an upper surface 125 of the protecting fins 121. With the term upper surface of the protective fin 121 is meant the face of the protective fin 121 parallel to the plane of the inserting face 133 and facing outwardly the sealing assembly 200. Consequently, an inner surface of the protecting fin 121 is a face opposing the outer fin's surface 125, which extends parallel to the plane of the inserting face 133 and faces the sealing core 130. The bottom surface of the protective fins 121 pushes the sealing core 130 so as to apply a homogeneous pressure onto the lip profile 134. More precisely, the dimensions of the protecting fins are chosen so that the contact area between the protective fins 120 and the lip profile 134 allows to evenly distributing the pressure on the entire lip profile 134 of the inserting hole 132. In this manner, the inserting channel 131 can be opened without producing structural stresses on the sealing core 130 so as to allow the metal box of the contact 300 to pass through the gel without an aggressive action. In other words the area of the bottom surface of the protective fins 121 is chosen so as to minimize structural stresses on the lip profile 134.

The performance of the sealing assembly 100, 200 depends on the section of the inserting channel 131, on the section of the contact 300 and on the section of the cable of the contact pin. In particular, if the sealing core 130 is made of a silicon material, the inserting channel 131 needs to have a section that allows inserting the contact 300 without damaging the structure of the sealing core 130 so that the inserting channel 131 can shrink to its original shape and be tight around the cable. The diameter of the inserting channel 131 can vary and is normally chosen based on the type of contacts in use.

If the sealing core 130 is made of a gel material the choice of the section of the inserting channel 131 is not limited by the section of the contact 300. Indeed, gel materials do not have a well defined structural network and even if the inserting channel 131 is arbitrarily deformed so as to allow insertion of the contact, same will close itself around the cable so as to seal the contact and the circuitry within the connector enclosure.

The thickness of the sealing core 130 as well as the thickness of the sealing assembly 100, 200 also vary based on the type of connector in which the sealing assembly has to be mounted and the type of application for which the sealing assembly is used.

In the above paragraph, for thickness of the sealing assembly and of the sealing core is meant the dimension in the direction perpendicular to the plane of the inserting face 130 and the outer inserting layer 110.

Figure 5:
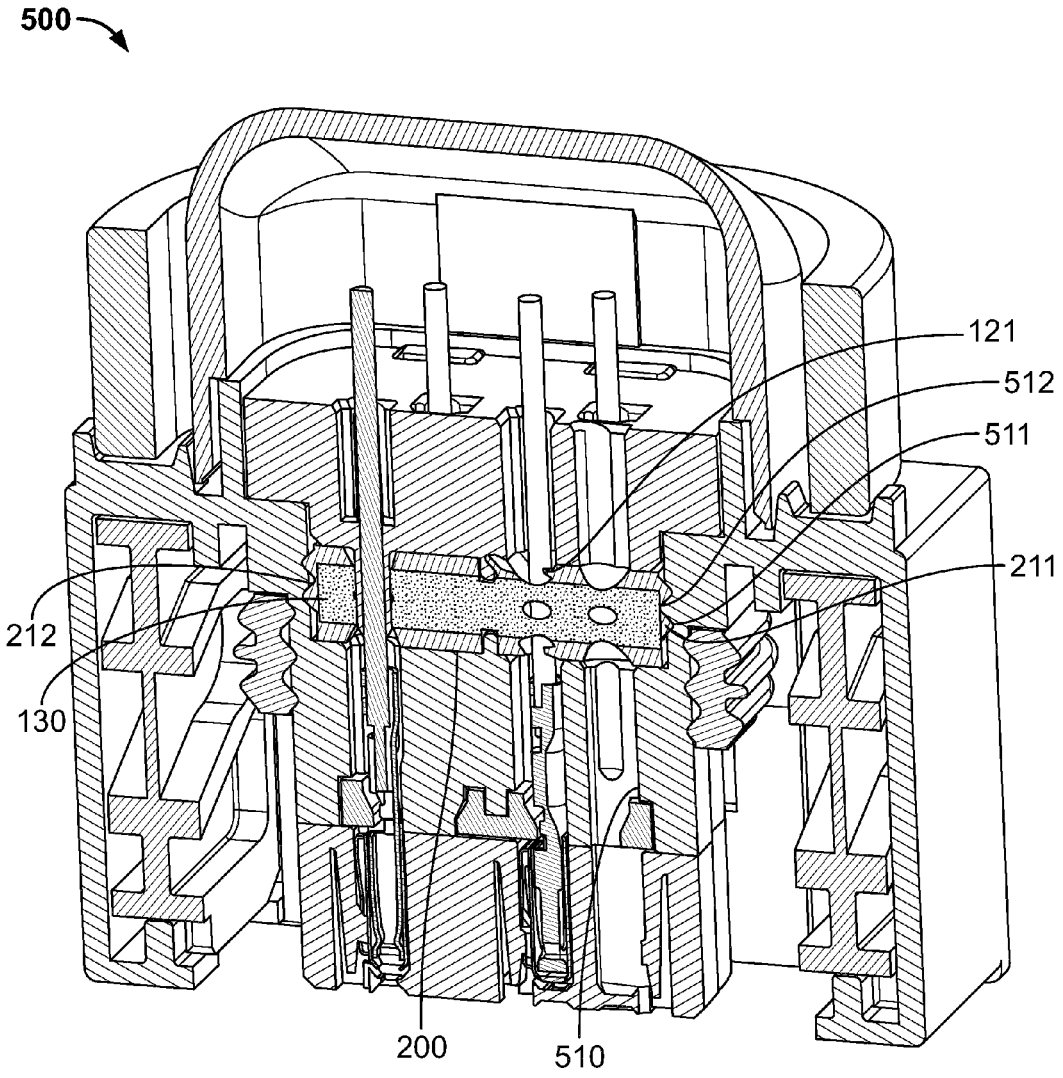
FIG. 5 is a perspective view of a section of a connector cavity including a sealing assembly according to an embodiment of the present invention.
Figure 6:
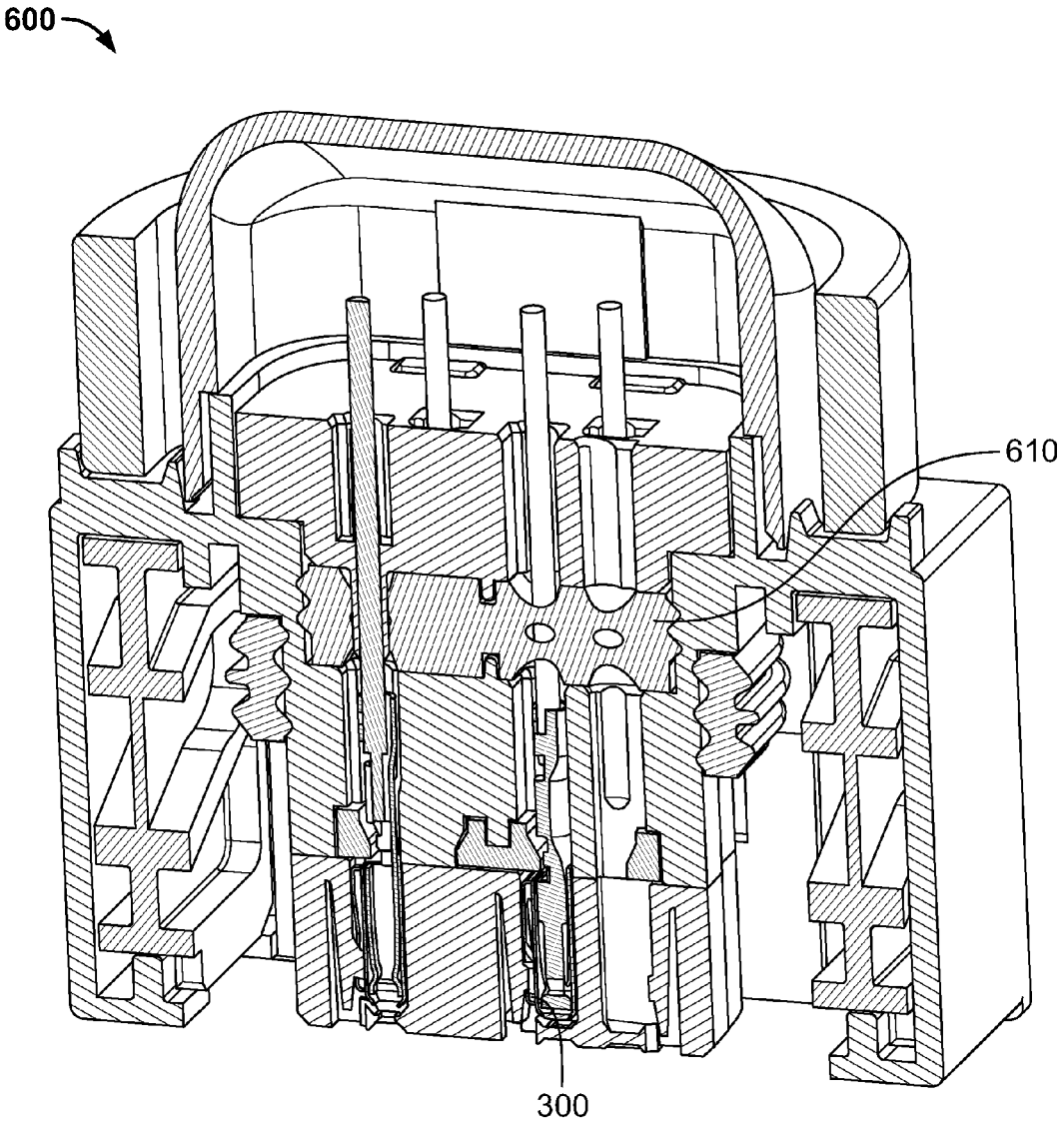
Fig. 6 PRIOR ART
FIG. 6 is a perspective view of a section of a connector cavity including a sealing assembly according to the prior art.
Figure 7:
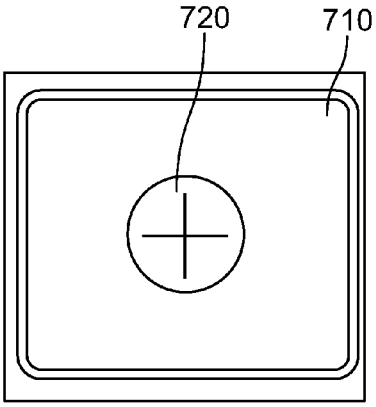
Fig. 7 PRIOR ART
FIG. 7 is a particular of an entry region of a seal Grommet according to the prior art.
Figure 8:
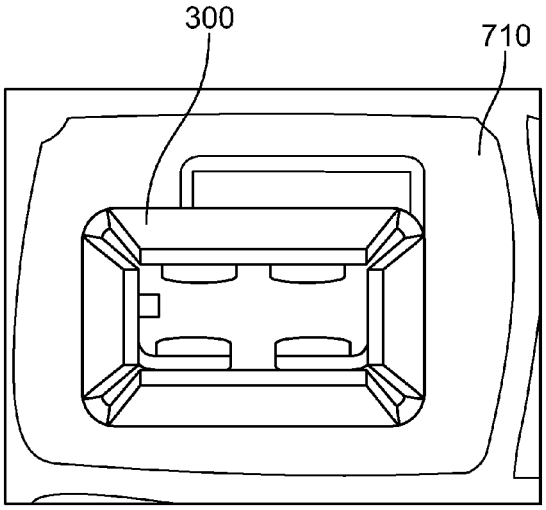
Fig. 8 PRIOR ART
FIG. 8 is a particular of an entry region of a seal Grommet according to the prior art during insertion of a contact.
Figure 9:
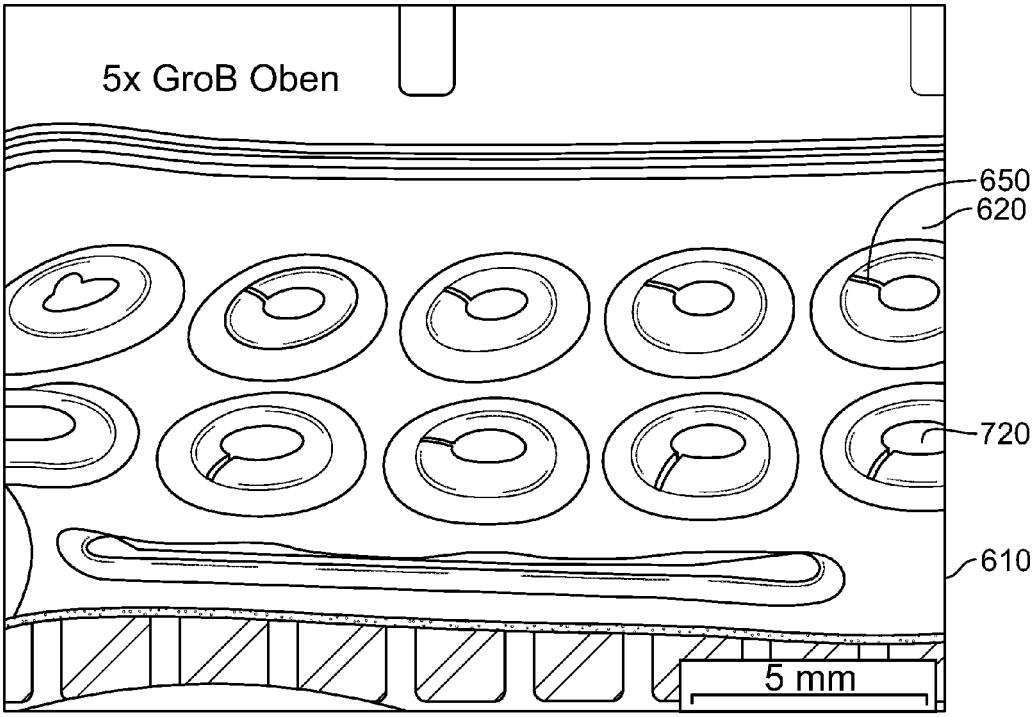
Fig. 9 PRIOR ART
FIG. 9 is a top view of a Grommet seal according to the prior art after three insertions/withdrawals of contacts.

FIG. 5 is a sectional view of a connector assembly including a sealing assembly 200 according to an embodiment of the present invention. The side face 210 of the sealing assembly 200 includes a plurality of grooves 212 and protrusions 211 that extend along the entire surface of the side face 210 in a direction parallel to the plane of the outer inserting layer 110.

The protrusions 211 and the grooves 212 respectively engage with corresponding grooves 511 and securing lips 512 on an inner face 510 of a connector cavity or enclosure 500. The engaging grooves and protrusions allow to firmly fixing the sealing assembly 200 to the connector cavity so that the contacts can be inserted or withdrawn from the connector cavity without displacing the sealing assembly 200 with respect to the connector cavity.

According to the present invention, a sealing assembly, which can be used for sealing an electric circuit of a connector, is provided. The sealing assembly 100, 200 include a soft, elastic core 130, which is compact when deformed and which includes one or more inserting channels 131 for inserting contacts. The sealing core 130 is adapted to be resiliently stretched so as to allow contacts to pass through the sealing core and subsequently recover its original shape so as to be tight around a contact cable. In this manner the contact as well as a circuit portion in a connector cavity can be sealed so as to be watertight and/or dust-tight. The sealing assembly 100, 200 includes upper inserting and exiting layers including a protecting member 121 placed in correspondence with the inserting channel 131. The protecting member may be in the form of protective fins 121 adapted to be positioned between the cutting edges of a contact and the sealing core 130 during insertion of the contact 300 in the sealing assembly 200.

The protecting fins 121, positioned so as to partially overlap the lip profile 134 of the inserting channel 131 and adapted to be placed between the inserting channel 131 and the cutting edges of a contact 300, allow performing a plurality of insertions or withdrawals of the contacts 300 without damaging the sealing core 130. Therefore, the present invention provides a sealing arrangement that is easy to produce and cost-efficient, altogether ensuring a reliable sealing performance over a high number of insertion and withdrawals of the contacts.

| Reference Numeral | Description |
|---|---|
| 100, 200 | Sealing assembly |
| 110 | Outer inserting layer |
| 120 | Protecting element |
| 121 | Protecting fin |
| 122 | Slit |
| 123 | Base of the protecting fin |
| 124 | outer face of the protecting fin |
| 125 | Protecting fin's outer surface |
| 126 | Protecting fin's free end |
| 130 | sealing core |
| 131 | Inserting channel |
| 132 | Inserting hole |
| 133 | Inserting face |
| 134 | Lip profile |
| 210 | Side face |
| 211 | Side face's protrusions |
| 212 | Side face's grooves |
| 220 | Outer body |
| 300 | Contact |
| 500 | Connector cross section |
| 510 | Inner face of the connector cavity |
| 511 | Grooves of the connector cavity |
| 512 | Securing lip of the connector cavity |
| 600 | Connector cavity according to the prior art |
| 610 | Grommet seal according to the prior art |
| 620 | Grommet seal's surface |
| 720 | Inserting hole according to the prior art |
| 710 | Entry region in the prior art |
| 650 | Cuts in the grommet seal (prior art) |

The invention claimed is:

1. A sealing assembly for sealing a connector, the sealing assembly, comprising:

a sealing core having an inserting face provided with an inserting hole adapted to receive a contact; and a first outer layer arranged on the inserting face of the sealing core and including at least one protecting element arranged so as to correspond to the inserting hole, the protecting element has an outer face adapted to abut the contact and facing outwardly from the sealing assembly, and an inner face adapted to contact with a lip profile defined by the inserting hole on the inserting face;

wherein the protecting element is further adapted to be disposed between the lip profile and an edge of the contact and to move inwardly towards the sealing core upon insertion of the contact into the sealing core, such as to protect the lip profile from the edge of the contact.

2. The sealing assembly of claim 1, wherein the protecting element is provided with a free end, the free end extending over the lip profile.

3. The sealing assembly of claim 1, wherein the protecting element includes a plurality of protecting fins, the protecting fins at least partially surrounding the inserting hole.

4. The sealing assembly of claim 1, wherein the protecting element is a protective film integrally covering the inserting hole, the protecting film being crossed by at least one blind cut adapted to brake so as to form protecting fins.

5. The sealing assembly of claim 1, wherein the sealing core is made of an elastic deformable material and the outer inserting layer is made of a hard material, the protecting element having a smooth surface.

6. The sealing assembly of claim 1, further including a second outer layer arranged on an exiting face of the sealing core opposing the inserting face, said second outer layer having at least one protecting element arranged so as to correspond to the insetting hole, wherein the protecting element is adapted to contact with an inner face thereof a lip profile of the inserting hole on the exiting face, and further adapted to be positioned between the lip profile and an edge of the contact upon withdrawal of the contact into the sealing assembly.

7. The sealing assembly of claim 6, further including an outer body enclosing the sealing core, the outer body including a side face, wherein the first and second outer layers are opposing faces of the outer body and are joined through the side face.

8. The sealing assembly of claim 1, wherein the sealing core is a gel and the outer inserting layer is made of a silicon material.

9. The sealing assembly of claim 7, wherein the side face of the outer body has one or more grooves.

10. A connector enclosure for an electric circuit, the connector enclosure having an inner face and at least one open face, the connector enclosure including a sealing assembly according to claim 1.

11. The connector enclosure of claim 10, wherein the sealing assembly includes an outer body provided with a side face, the side face including at least one groove; and wherein the inner face of the connector enclosure includes at least a securing lip adapted to engage with the at least one groove so as to secure the sealing assembly in a redetermined position.

12. A sealing assembly for sealing a connector, the sealing assembly, comprising:

a sealing core having an inserting face provided with an inserting hole adapted to receive a contact; and a first outer layer arranged on the inserting face of the sealing core and including at least one protecting element arranged so as to correspond to the inserting hole, a second outer layer arranged on an exiting face of the sealing core opposing the inserting face, said second outer layer having at least one protecting element arranged so as to correspond to the inserting hole, wherein the protecting element is adapted to contact with an inner face thereof a lip profile of the inserting hole, and further adapted to be positioned between the lip profile and an edge of the contact upon insertion of the contact into the sealing assembly, and wherein the protecting element is adapted to contact with an inner face thereof a lip profile of the inserting hole on the exiting face, and further adapted to be positioned between the lip profile and an edge of the contact upon withdrawal of the contact into the sealing assembly.

13. The sealing assembly of claim 12, further including an outer body enclosing the sealing core, the outer body including a side lace, wherein the first and second outer layers are opposing faces of the outer body and are joined through the side face.

* * * * *